US005205090A

United States Patent [19]

Lavery

[11] Patent Number: 5,205,090

[45] Date of Patent: Apr. 27, 1993

[54] BUILDING BLOCK, AND WALL OR YARD EDGING THEREFROM

[76] Inventor: Terrence J. Lavery, 167 Hawkins Cir., Wheaton, Ill. 60187

[21] Appl. No.: 777,005

[22] Filed: Oct. 16, 1991

[51] Int. Cl.[5] ..... E04C 1/10; E02D 27/00

[52] U.S. Cl. ..... 52/102; 52/593; 47/33; 404/7

[58] Field of Search ..... 52/284–286, 52/503, 585, 589–595, 603–609, 102, 103; 404/39–41, 6–8; 47/33

[56] References Cited

U.S. PATENT DOCUMENTS

| | | | |
|---|---|---|---|
| 57,461 | 8/1866 | Bartlett et al. | 52/594 |
| 497,959 | 5/1893 | Hesz | 52/585 |
| 1,334,599 | 5/1920 | Cusick | 52/585 |
| 1,689,107 | 10/1928 | Bradley | 52/594 |

FOREIGN PATENT DOCUMENTS

| | | | |
|---|---|---|---|
| 627977 | 5/1929 | Fed. Rep. of Germany | 52/503 |
| 979394 | 4/1951 | France | 52/594 |

*Primary Examiner*—James L. Ridgill, Jr.
*Attorney, Agent, or Firm*—Mathew R. P. Perrone, Jr.

[57] ABSTRACT

A block suitable for use as edging or wall formation has on one end thereof a conically shaped, hemispherical indentation in the surface thereof, and a corresponding protruding member as a male protrusion thereof. On the other end of the block, the positioning of this corresponding protruding member and indentation are reversed. Thus, the bricks can be laid end to end and supported. The slots in the brick and the top step permit a strong block shape. The lip also permits a stepped portion structure to form a wall having the height of several layers of bricks or blocks.

11 Claims, 5 Drawing Sheets

BUILDING BLOCK, AND WALL OR YARD EDGING THEREFROM

This invention relates to an interlocking building block, and more particularly to an interlocking building block and walls made from a plurality thereof in order to form a sea-wall, a border at the edge of a lawn or a sidewalk, and similar items.

BACKGROUND OF THE INVENTION

It is critical that a brick or block for forming a wall be simply assembled into that wall. Block and brick may be used interchangeably as terms herein. It is always desired to design a block that a layman can use. A layman must be able to use the block in a simple fashion and achieve the same strength and appearance of a wall as a professional can achieve.

If the block has a complicated structure and is hard to manufacture, it follows that the layman cannot use it to build the wall, in a simple fashion. It further is clear, that the difficulty of manufacturing increases the cost of the block for the consumer. Thus, it is desired to simplify this structure while at the same maintaining the necessary strength of the wall made from the block.

If the blocks are used to form an edge or a border for a yard or a sidewalk, the edge thus formed from the blocks must have sufficient strength to keep natural shifts therein from pushing the blocks along the edge thereof out of the way. In this manner, the edge or border can keep the desired appearance and strength factors. Such shifts can push aside almost any type of edge structure. The brick or block must be shapeable into a strong edge form.

When a sea wall or a retaining wall is desired, the block must have a dual function. The wall requires a block with both an end, and a top to bottom joining mechanisms. If these joining mechanisms are simply joined, the layman can use it to build the wall. This block structure must be simplified, while at the same maintaining the necessary strength of the wall.

SUMMARY OF THE INVENTION

Accordingly, among the many objects of this invention is to provide an interlocking building block and wall.

A further objective of this invention is to provide a seawall from a plurality of an interlocking building block.

Still a further objective of this invention is to provide a retaining wall from a plurality of an interlocking building block.

Yet a further objective of this invention is to provide a yard border from a plurality of an interlocking building block.

Also an objective of this invention is to provide an interlocking building block suitable for simplified assembly.

Another objective of this invention is to provide a method for building a seawall from a plurality of an interlocking building block.

Yet another objective of this invention is to provide a method for building a retaining wall from a plurality of an interlocking building block.

Still another objective of this invention is to provide a method for building a yard border from a plurality of an interlocking building block.

These and other objectives of this invention are met by providing a particular block has on one end thereof a conically shaped, hemispherical indentation in the surface thereof, and a corresponding protruding member as a male protrusion thereof. On the other end of the block, the positioning of this corresponding protruding member and indentation are reversed. Thus, the bricks can be laid end to end and supported. The slots in the brick and the top step permit a strong block shape. The lip also permits a stepped portion structure to form a wall having the height of several layers of bricks or blocks.

BRIEF DESCRIPTION OF THE DRAWINGS

Throughout the figures of the drawing, where the same part appears in more than one figure of the drawing, the same number is applied thereto.

DESCRIPTION OF THE PREFERRED EMBODIMENTS

This particular block has on one end thereof a conically shaped, hemispherical indentation in the surface thereof, and a corresponding protruding member as a male protrusion thereof. On the other end of the block, the positioning of this corresponding protruding member and indentation are reversed. Thus, the bricks can be laid end to end and supported. The slots in the brick and the decorative portion of the top step permit a strong block. The lip also permits a stepped portion structure to form a wall having several levels. In this fashion, the desired results can be obtained.

On the top of the block can be seen a step and the protuberance. Brick and block are interchangeable terms for the purpose of this invention. On the base of the block can be seen a receiving member for the step portion. On the rear and front of the block are situated slots for decorative purposes, strength purposes or stabilizing purposes. In this way the soil can better grip the block or brick and hold it in place.

Also the slots in the block are useful. The slot or slots in the front side of the block adds to the strength of the block, while simplifying the molding and formation of each individual block, so that the block may be formed more efficiently and at less cost. The slot on the rear side of the block supports the yard edge or sidewalk edge, and adds to block strength in addition to permitting the block to be formed more efficiently.

Figure 1:
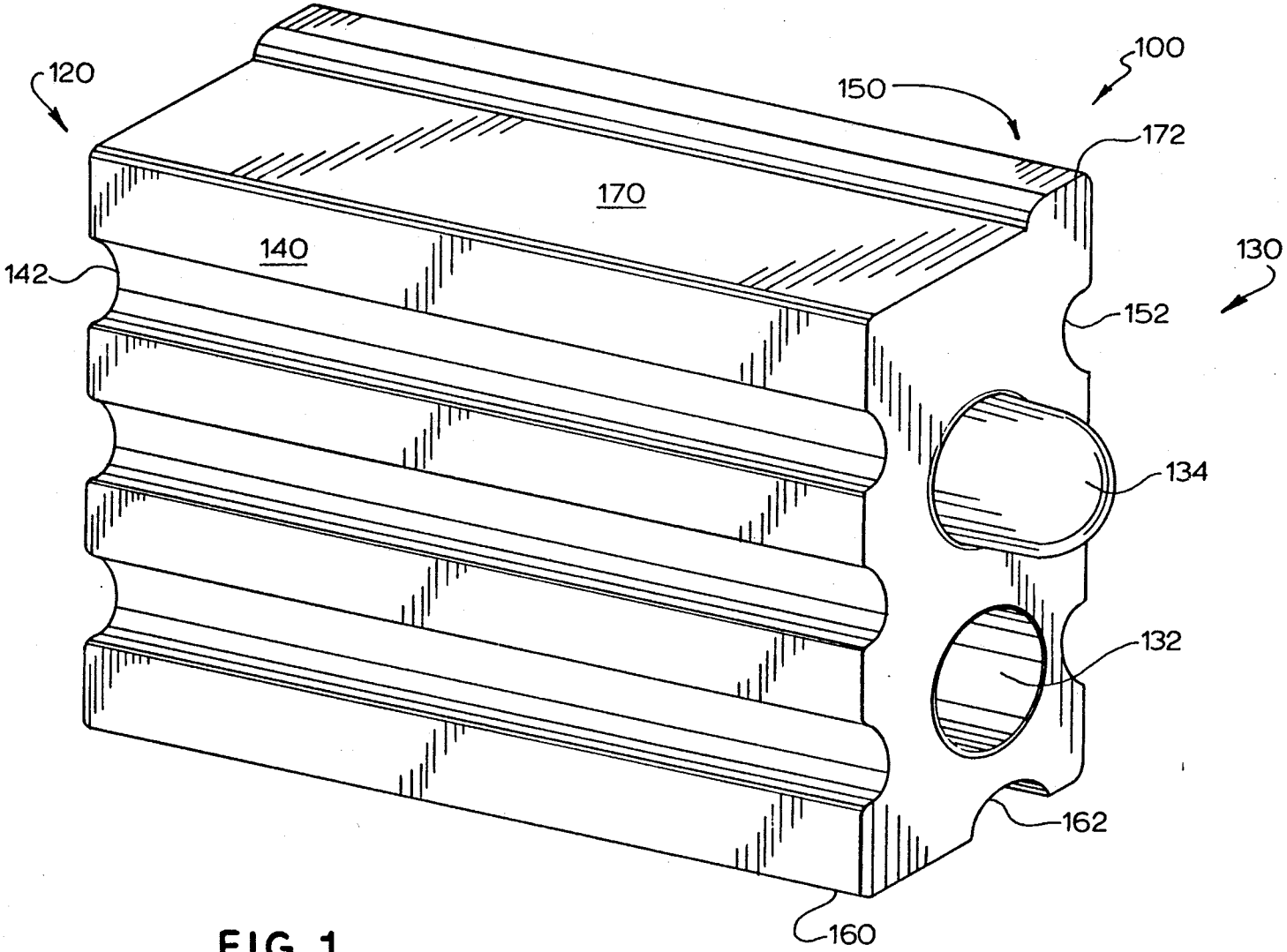
FIG. 1 depicts a perspective view of an interlocking building block 100 of this invention.
Figure 4:
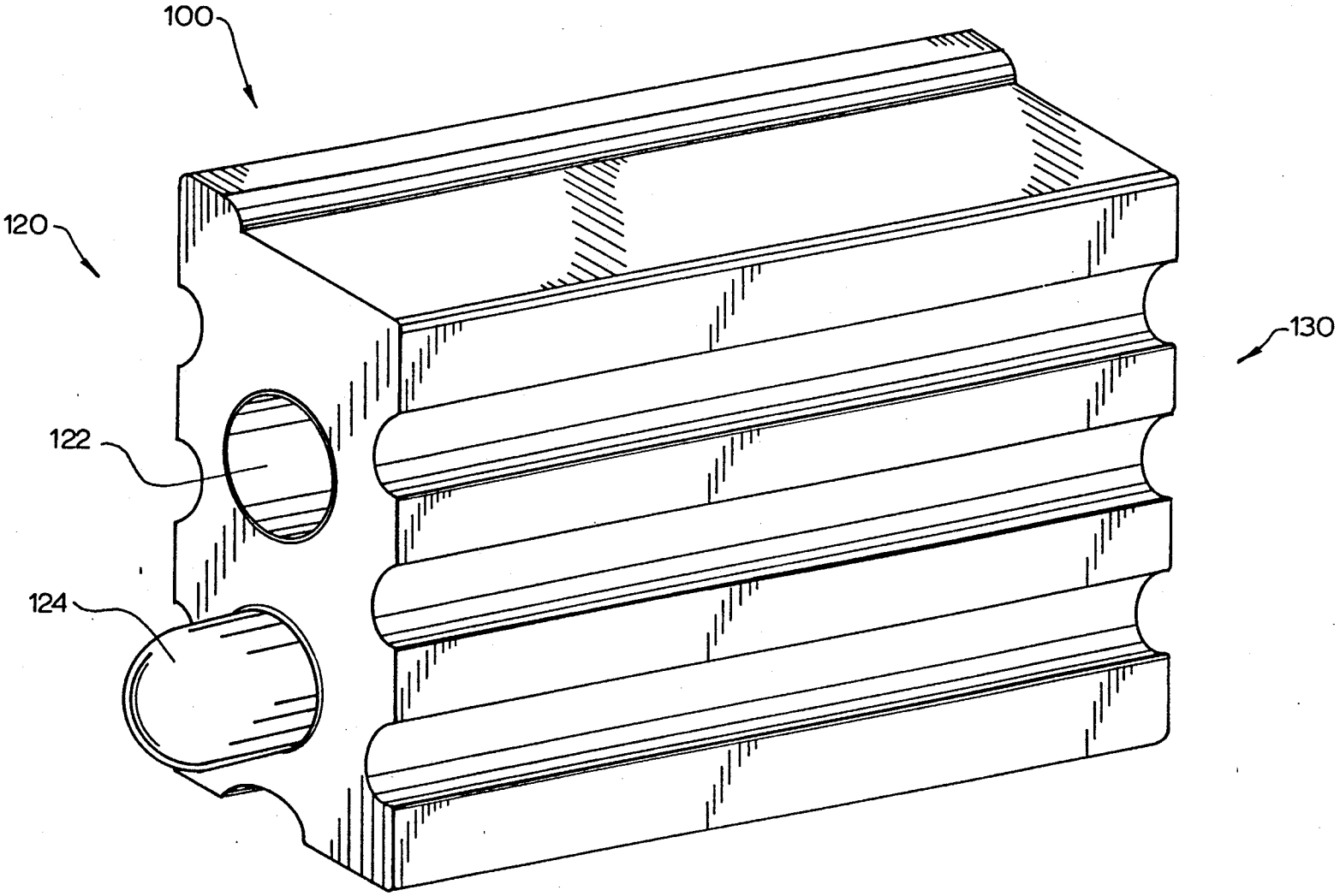
FIG. 4 depicts a perspective view of an interlocking building block 100 of this invention, which is a reversed view of FIG. 1.

Referring now to FIG. 1 and FIG. 4, the block 100 has on a first end 120 thereof a first female, conically-shaped hemispherical indentation 122 in the surface thereof, and a corresponding a first male protrusion 124. A second end 130 of block 100 is oppositely disposed from first end 120. The block 100 has on a second end 130 thereof a second female, conically-shaped hemispherical indentation 132 in the surface thereof, and a corresponding a second male protrusion 134.

When a first end 120 of one block 100 is placed adjacent to a second end 130 of another block 100, the first female, conically-shaped hemispherical indentation 122 lines up with and receives the second male protrusion 134. Likewise, the first male protrusion 124 is simultaneously received by the second female, conically-shaped hemispherical indentation 132. The reverse positioning thereof achieves this result.

Figure 2:
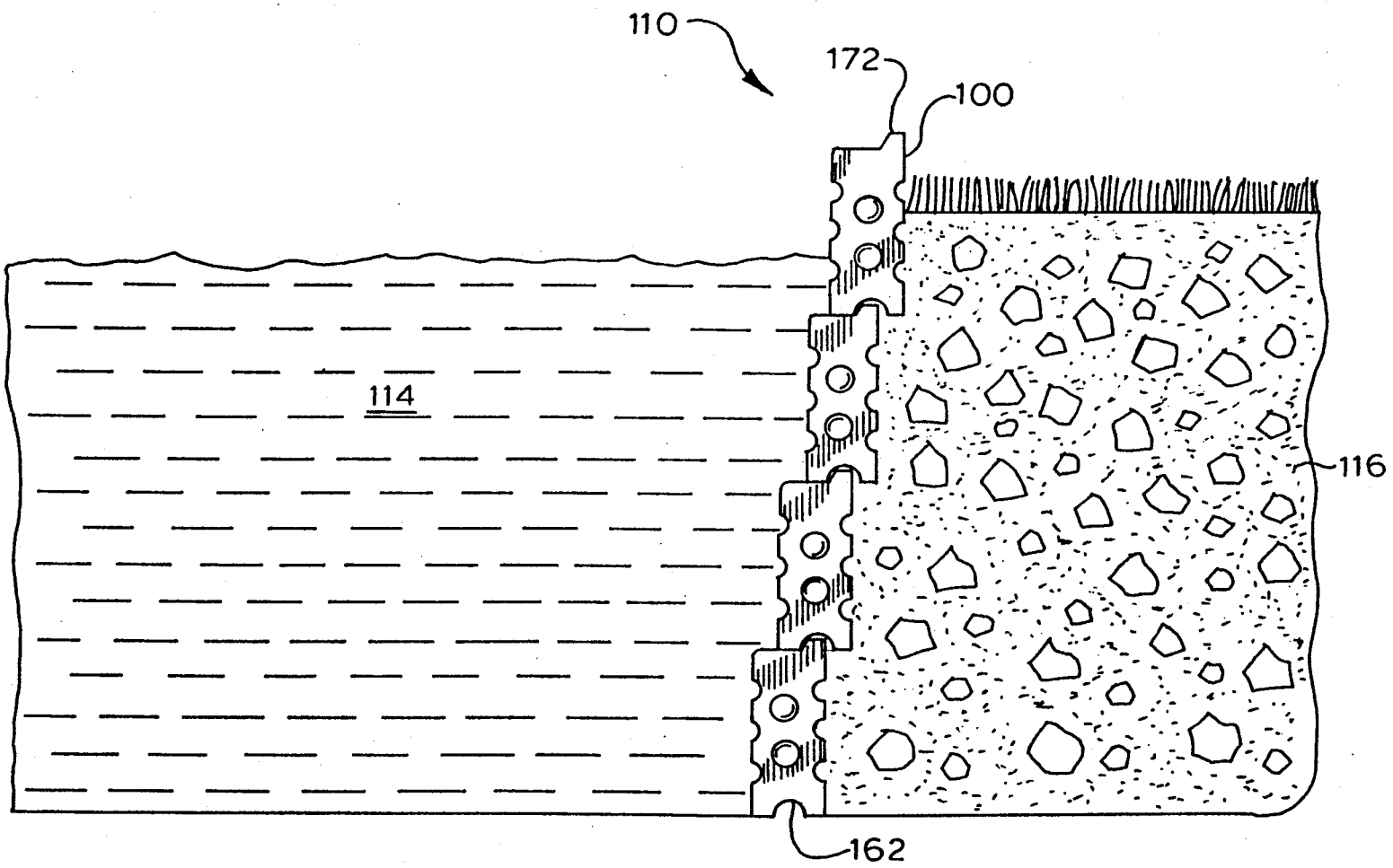
FIG. 2 depicts a perspective view of a seawall 110 formed from a plurality of the interlocking building block 100 of this invention.

This structure is the basis for FIG. 2, which depicts a side view, cross-sectional view of seawall 110 formed from a plurality of the interlocking building block 100. Bottom slot 162 can receive lip 172 for forming seawall 110 and separating a body of water 114 from land 116 by a vertical and horizontal stack of block 100. First end 120 combines with second end 130 to achieve horizontal stability. Bottom slot 162 and lip 172 combine to form vertical stability.

Figure 3:
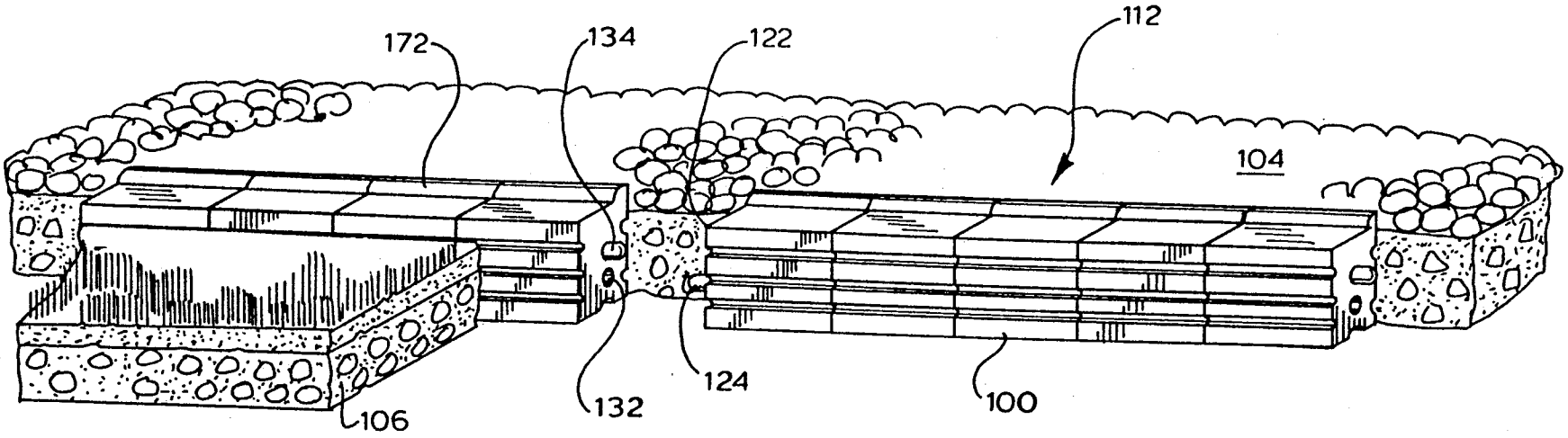
FIG. 3 depicts a perspective view of a yard edging 112 formed from a plurality of the interlocking building block 100 of this invention.

Likewise, FIG. 3 depicts a perspective view of a yard edging 112 formed in a horizontally stable fashion from a plurality of the interlocking building block 100. Yard edging 112 separates yard 106 from driveway 104. Driveway 104 may also be a sidewalk or similar structure. First end 120 combines with second end 130 to achieve the horizontal stability required for the edging. The below described rear side slot 152 and face slot 142 add to horizontal stability by permitting earth gripping therein.

Considering again FIG. 1 and FIG. 4, there is also a face 140 of the block 100. Within face 140, is at least one face slot 142 perpendicular to both first end 120 and second end 130. Three of face slot 142 are preferred. Face slot 142 is preferred to a have a semicircular cross-section for ease of molding, although other shapes are operable.

There is rear side 150 of the block 100. Rear side 150 is oppositely disposed from face 140. Rear side 150 includes at least one rear side slot 152. Rear side slot 152 is similar to face slot 142 in purpose and structure.

Figure 5:
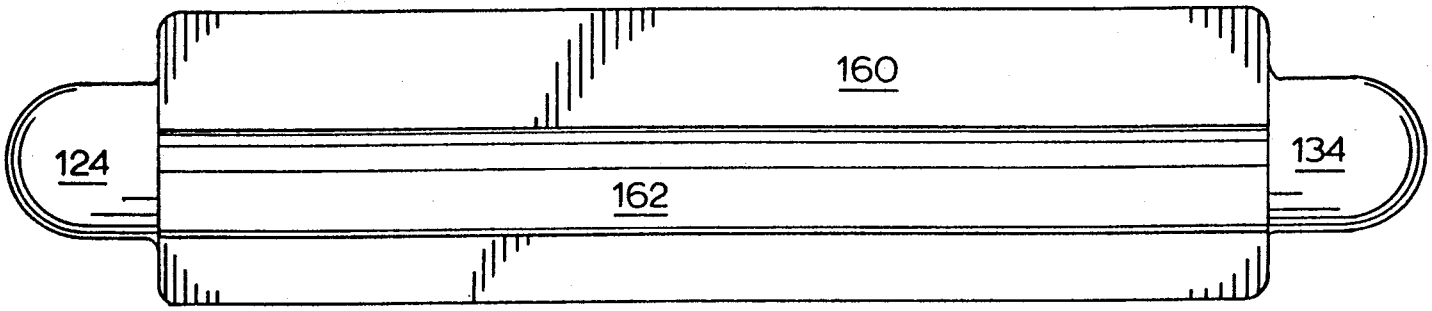
FIG. 5 depicts a bottom perspective view of an interlocking building block 100 of this invention.

Referring now to FIG. 5, bottom side 160 of block 100 includes a bottom slot 162. Bottom slot 162 can assist the gripping of the ground by the block 100 or receive lip 172 for forming seawall 110 or a similar structure, such as retaining wall. Bottom slot 162 is similar to face slot 142, and is substantially centrally located in bottom side 160.

Figure 6:
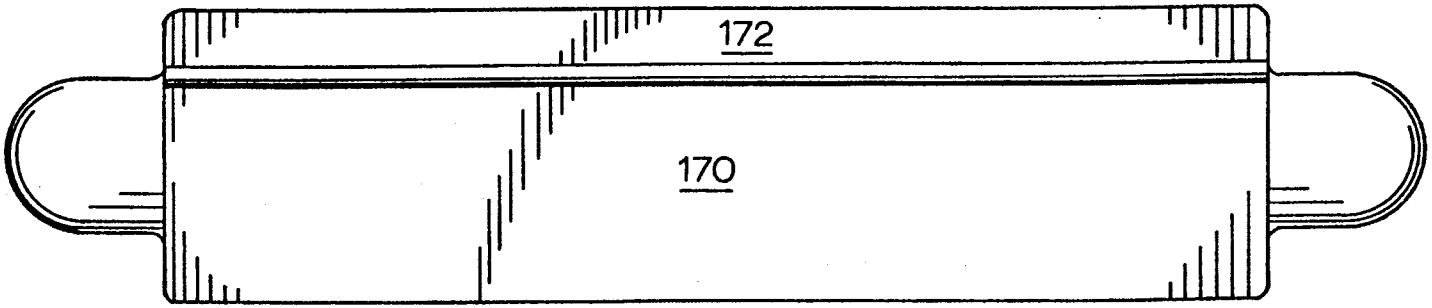
FIG. 6 depicts a top perspective view of an interlocking building block 100 of this invention.

When considering FIG. 6, top side 170 of block 100 includes a lip 172 located adjacent to rear side 150. Lip 162 protrudes upwardly out of top side 170. Clearly on the generally rectangular solid-based shape of block 100, top side 170 is oppositely disposed from bottom side 160.

The various theories for stability for edging and wall stability of block 100 are postulates only. The walls and edgings may be strong for any reason. The first female, conically-shaped hemispherical indentation 122, first male protrusion 124, second female, conically-shaped hemispherical indentation 132, and second male protrusion 134 may be of any suitable shape. Likewise, bottom slot 162, face slot 142, and rear side slot 152 may be of any suitable shape.

The first female, conically-shaped hemispherical indentation 122 is substantially coaxial with the second male protrusion 134. The first male protrusion 124 and second female, conically-shaped hemispherical indentation 132 are also coaxial. Lip 162 is generally at an edge of top side 170, while bottom slot 162 is usually centrally located.

This application — taken as a whole with the specification, claims, abstract, and drawings — provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modifications of this method and apparatus can become clear to a person having ordinary skill in this particular art. Such modifications are clearly covered by this disclosure.

What is claimed and sought to be protected by Letters Patent of the United States is:

I claim:

1. An interlocking building block having a capability of being formed into a structure, comprising:

a) said block being of a generally rectangular solid shape;

b) said block having a front side, back side, a bottom side, a top side, a first end and a second end;

c) said front side being oppositely disposed from said back side;

d) said bottom side being oppositely disposed from said top side;

e) said first end being oppositely disposed from said second end;

f) said first end having a first indentation and a first protruding member;

g) said second end having a second indentation and a second protruding member;

h) said first indentation being adapted to receive said second protruding member;

g) said second indentation being adapted to receive said first protruding member;

h) said top side having a protruding lip;

i) said bottom side having a bottom slot;

j) said bottom slot being adapted to receive said protruding lip;

k) said front side having at least one horizontal front slot;

l) said back side having at least one horizontal back slot;

m) said first indentation and said second protruding member being substantially coaxial;

n) said second indentation and said first protruding member and said second protruding member being substantially coaxial;

o) said first indentation and said second indentation being substantially symmetrical;

p) said first protruding member and said second protruding member are substantially symmetrical;

q) said first indentation and said second indentation being substantially hemispherical or conical; and r) said first protruding member and said second protruding member being substantially hemispherical or conical.

2. The block of claim 1, further comprising:

a) said protruding lip being a stepped protuberance; and b) said bottom slot being adapted to receive said stepped protuberance.

3. The block of claim 1, further comprising:

a) said front side having at least one front arcuate horizontal slot;

b) said rear side having at least one rear arcuate horizontal slot; and c) said at least one front arcuate horizontal slot and said at least one rear arcuate horizontal slot having both a decorative and strength function.

4. The block of claim 3, further comprising a plurality of said block is formed into a yard edging.

5. The block of claim 3, further comprising a plurality of said block is formed into a sea wall.

6. The block of claim 3, further comprising a plurality of said block is formed into a retaining wall.

7. The block of claim 3, wherein said at least one front arcuate horizontal slot and said at least one rear arcuate horizontal slot have a semicircular cross-section.

8. In a seawall formed from a plurality of an interlocking building block, the improvement wherein said block has a structure permitting assembly of said block into said seawall, comprising:

a) said block being of a generally rectangular solid shape;

b) said block having a front side, back side, a bottom side, a top side, a first end and a second end;

c) said front side being oppositely disposed from said back side;

d) said bottom side being oppositely disposed from said top side;

e) said first end being oppositely disposed from said second end;

f) said first end having a first indentation and a first protruding member;

g) said second end having a second indentation and a second protruding member;

h) said first indentation being adapted to receive said second protruding member;

i) said second indentation being adapted to receive said first protruding member;

j) said top side having a protruding lip;

k) said bottom side having a bottom slot;

l) said bottom slot being adapted to receive said protruding lip;

m) said first indentation and said second protruding member being substantially coaxial;

n) said second indentation and said first protruding member and said second protruding member being substantially coaxial;

o) said front side having at least one horizontal front slot;

p) said back side having at least one horizontal back slot;

q) said first indentation and said second indentation being substantially symmetrical;

r) said first protruding member and said second protruding member being substantially symmetrical;

s) said first indentation and said second indentation being substantially hemispherical or conical; and t) said first protruding member and said second protruding member being substantially hemispherical or conical.

9. The block of claim 8, wherein:

a) said protruding lip being a stepped protuberance; and b) said bottom slot being adapted to receive said stepped protuberance.

10. The block of claim 9, wherein:

a) said front side having at least one front arcuate horizontal slot;

b) said rear side having at least one rear arcuate horizontal slot;

c) said at least one front arcuate horizontal slot and said at least one rear arcuate horizontal slot serving both a decorative and strength function; and d) said at least one front arcuate horizontal slot and said at least one rear arcuate horizontal slot having a semicircular cross-section.

11. In a yard edging formed from a plurality of an interlocking building block, the improvement wherein said block has a structure permitting assembly of said block into said seawall, wherein:

a) said block being of a generally rectangular solid shape;

b) said block having a front side, back side, a bottom side, a top side, a first end and a second end;

c) said front side being oppositely disposed from said back side;

d) said bottom side being oppositely disposed from said top side;

e) said first end being oppositely disposed from said second end;

f) said first end having a first indentation and a first protruding member;

g) said second end having a second indentation and a second protruding member;

h) said first indentation being adapted to receive said second protruding member;

i) said second indentation being adapted to receive said first protruding member;

j) said top side having a protruding lip;

k) said bottom side having a bottom slot;

l) said bottom slot being adapted to receive said protruding lip;

m) said first indentation and said second protruding member being substantially coaxial;

n) said second indentation and said first protruding member being substantially coaxial;

o) said front side having at least one horizontal front slot;

p) said back side having at least one horizontal back slot;

q) said first indentation and said second indentation being substantially symmetrical;

r) said first protruding member and said second protruding member being substantially symmetrical;

s) said first indentation and said second indentation being substantially hemispherical or conical; and t) said first protruding member and said second protruding member being substantially hemispherical or conical.

* * * * *